US008727718B2

(12) United States Patent
Aschenbruck et al.

(10) Patent No.: US 8,727,718 B2
(45) Date of Patent: May 20, 2014

(54) TURBINE ROTOR FOR A GAS TURBINE

(75) Inventors: Emil Aschenbruck, Duisburg (DE); Ralf Müller, Essen (DE); Michael Blaswich, Oberhausen (DE)

(73) Assignee: MAN Diesel & Turbo SE, Augsburg (DE)

( * ) Notice: Subject to any disclaimer, the term of this patent is extended or adjusted under 35 U.S.C. 154(b) by 315 days.

(21) Appl. No.: 12/864,039

(22) PCT Filed: Nov. 3, 2008

(86) PCT No.: PCT/EP2008/009258

§ 371 (c)(1),
(2), (4) Date: Jul. 22, 2010

(87) PCT Pub. No.: WO2009/118036

PCT Pub. Date: Oct. 1, 2009

(65) Prior Publication Data

US 2010/0290911 A1 Nov. 18, 2010

(30) Foreign Application Priority Data

Mar. 26, 2008 (DE) ..... 10 2008 015 688

(51) Int. Cl.
*F01D 5/30* (2006.01)
*F01D 5/06* (2006.01)

(52) U.S. Cl.
USPC ..... 415/199.5; 415/104

(58) Field of Classification Search
USPC ..... 415/198.1, 199.4, 199.5, 229, 142, 104, 415/216.1
See application file for complete search history.

(56) References Cited

U.S. PATENT DOCUMENTS

| | | | | |
|---|---|---|---|---|
| 3,680,979 | A | 8/1972 | Hansen et al. | |
| 4,247,256 | A * | 1/1981 | Maghon | 416/198 A |
| 4,715,778 | A | 12/1987 | Katayama et al. | |
| 5,537,814 | A * | 7/1996 | Nastuk et al. | 60/796 |
| 7,510,380 | B2 * | 3/2009 | Alam et al. | 416/244 R |

FOREIGN PATENT DOCUMENTS

| | | |
|---|---|---|
| CH | 225640 | 2/1943 |
| DE | 36 14 144 | 10/1987 |
| FR | 1 282 459 | 1/1962 |
| FR | 1282459 | 1/1962 |
| JP | 51-1082 | 4/1975 |
| JP | 05-106466 | 4/1993 |
| JP | 08-240127 | 9/1996 |

(Continued)

*Primary Examiner* — Ned Landrum
*Assistant Examiner* — Justin Seabe
(74) *Attorney, Agent, or Firm* — Cozen O'Connor

(57) ABSTRACT

A turbine rotor (1) for a gas turbine with a one-piece compressor housing (11) or a compressor housing (11) which is divided in a first plane, a one-piece turbine housing (12) connected to the compressor housing (11) or a turbine housing (12) which is divided in a second plane different from the first plane comprises a compressor area which includes at least two compressor disks (2.1-2.5) and a turbine area which includes at least one turbine disk (13.1, 13.2). The compressor disks and turbine disks are clamped together by a tie rod arrangement which includes at least one tie rod (6) which has a first fastening area, a second fastening area for clamping at least two compressor disks between the first fastening area and the second fastening area, and a third fastening area for clamping at least one turbine disk.

4 Claims, 2 Drawing Sheets

(56) References Cited

FOREIGN PATENT DOCUMENTS

| | | |
|---|---|---|
| JP | 2006-138255 | 6/2006 |
| WO | WO 03/054355 | 7/2003 |
| WO | WO03/054355 | 8/2003 |
| WO | WO2004/076820 | 9/2004 |
| WO | WO 2004/076820 | 9/2004 |

* cited by examiner

TURBINE ROTOR FOR A GAS TURBINE

FIELD OF THE INVENTION

The invention is directed to a turbine rotor for a gas turbine, a gas turbine with a turbine rotor of this kind, a tie rod for a turbine rotor of this kind, and a method for mounting a turbine rotor in a gas turbine.

BACKGROUND OF THE INVENTION

Gas turbine rotors have a compressor area and a turbine area. At least the compressor area, and often also the turbine area, can comprise multiple parts in a disk-type construction having at least two compressor disks and/or turbine disks. The disks are preferably positioned relative to one another by centering means and are clamped together by tie rods to form a rotor composite.

When a housing of the gas turbine is divided in a continuous manner, e.g., horizontally, the gas turbine rotor can be completely assembled beforehand and balanced before being arranged in its entirety in the housing.

However, in the known in-house gas turbine shown in FIG. 1 with horizontally divided housing in the compressor area and one-piece housing in the turbine area, the gas turbine rotor 1' cannot be fully assembled beforehand for installation. In this case, the compressor area is first clamped by means of a plurality of peripheral tie rods 4 and placed in the compressor housing. The compressor housing is subsequently closed and the one-piece turbine housing is mounted. In so doing, the turbine area in the form of individual turbine disks 13.1', 13.2' is fastened to the gas turbine rotor so as to alternate with the turbine housing. The turbine disks 13.1', 13.2' are fastened to one another and to the compressor area by means of separate peripheral tie rods 5.

This construction is complicated and is not as robust because of the axially divided tie rods 4, 5.

Therefore, it is the object of the present invention to improve a turbine rotor for a gas turbine.

SUMMARY OF THE INVENTION

This object is met by a turbine rotor for a gas turbine having a compressor area comprising at least two compressor disks and a turbine area comprising at least one turbine disk, wherein the compressor disks and turbine disks are clamped together by a tie rod arrangement having at least one tie rod which has a first fastening area, a second fastening area for clamping at least two compressor disks between the first fastening area and the second fastening area, and a third fastening area for clamping at least one turbine disk. Also disclosed is a gas turbine with a one-piece compressor housing or a compressor housing which is divided in a first plane, a one-piece turbine housing connected to the compressor housing or a turbine housing which is divided in a second plane different from the first plane, and the above described turbine rotor. Included in the present invention is a tie rod for the above described turbine rotor with a first fastening area, a second fastening area for clamping at least two compressor disks between the first fastening area and second fastening area, and a third fastening area for clamping at least one turbine disk and a method for mounting the above described turbine rotor in a gas turbine comprising the following steps: clamping at least two compressor disks between the first fastening area and the second fastening area by means of the tie rod arrangement; arranging the clamped compressor disks in the compressor housing; and clamping at least one turbine disk.

A turbine rotor according to the invention for a gas turbine comprises a compressor area comprising two or more compressor disks and a turbine area comprising one or more, preferably two or more, turbine disks. The compressor disks and turbine disks can carry one (single disk) or more (multi-disk) rows of rotor blades. The compressor disks and turbine disks are clamped together by a tie rod arrangement having one tie rod which is preferably coaxial to the longitudinal axis of the turbine rotor, i.e., a central tie rod, or a plurality of tie rods which are preferably parallel to the longitudinal axis of the turbine rotor and distributed equidistantly in circumferential direction, i.e., peripheral tie rods.

One or more, preferably all, of the tie rods of the tie rod arrangement have a first fastening area and a second fastening area for clamping two or more, preferably all, of the compressor disks of the compressor area between the first fastening area and second fastening area. Further, at least one tie rod, preferably a plurality of tie rods, particularly preferably all of these tie rods, which are advantageously formed in one piece axially, have a third fastening area for clamping one or more, preferably all, of the turbine disks of the turbine area.

In other words, according to the invention, the compressor disks and turbine disks are clamped by means of the same tie rod(s). As will be explained in more detail in the following, a second fastening area by means of which compressor disks can be preloaded relative to one another is provided for pre-assembly of the compressor area.

Therefore, a turbine rotor according to an embodiment of the present invention can be mounted in a housing of a gas turbine which is not continuously divided in that two or more, particularly all, of the compressor disks of the compressor area are first clamped together by the tie rod or tie rods between the first fastening area and the second fastening area. To this end, for example, a first thread of the first fastening area which is preferably formed at a front end of the tie rod(s) with reference to the through-flow direction is screwed to a front, particularly a frontmost, compressor disk or a first nut which is arranged in front of this compressor disk with respect to the through-flow direction and is supported on it.

A rear, particularly rearmost, compressor disk or a second nut which is arranged behind this compressor disk with respect to the through-flow direction and is supported on it is subsequently screwed to a second thread of the second fastening area which is preferably formed between two end sides of the tie rod(s).

The turbine rotor which is clamped in this way between the first fastening area and second fastening area and which comprises only the compressor area up to this point can advantageously be balanced.

In another intermediate step, one or more, particularly all, of the turbine disks of the turbine area can subsequently be clamped to one another or to axial stops by the tie rod(s). To this end, the turbine disks are placed on the tie rod arrangement and a third thread of the third fastening area which is preferably formed at a rear end of the tie rod(s) with respect to the through-flow direction is screwed to a rear, preferably a rearmost, turbine disk or a third nut which is arranged behind this turbine disk with respect to the through-flow direction and is supported on it. The complete turbine rotor which is clamped in this manner and which comprises the compressor area and the turbine area can be balanced again. The turbine disks are then detached from the tie rod arrangement again.

After this additional intermediate step, which can also be omitted, the preloaded turbine rotor comprising only the compressor area is arranged in a compressor housing which can be divided, e.g., horizontally.

A turbine housing which is, e.g., formed in one piece is now mounted and connected to the compressor housing, the turbine disks are again placed on the tie rod arrangement, and the third thread is screwed to the rear turbine disk or third nut. The individual turbine disks can also be mounted so as to alternate with the turbine housing, which can be divided one or more times transverse to the longitudinal axis for this purpose, and can subsequently be clamped together by the third fastening area.

The clamping by means of the fastening areas can be realized in addition to or as an alternative to a threaded connection by other clamping elements which can clamp the compressor disks and turbine rotors, respectively, against one another axially. For example, in addition to or as an alternative to a thread, the first, second and/or third fastening area(s) can have radial cutouts in which wedges are fitted which clamp the disks axially owing to the wedge effect. Also, additionally or alternatively, the first, second and/or third fastening area can also comprise grooves for receiving axial retaining rings which fix the disks in an axially preloaded state.

Therefore, a fastening area designates a portion of a tie rod or tie rod arrangement to which one or more clamping elements of the turbine rotor such as a front or rear compressor disk or turbine disk or a threaded nut can be fastened axially at least on one side in such a way that they can introduce an axial force into the tie rod or tie rod arrangement which axially clamps together the compressor disks and turbine disks, respectively.

If the clamping element which serves to preload the compressor area can be fastened axially only on one side opposite to the preloading direction as is the case, for example, when a rear or rearmost compressor disk is supported on one side by a threaded nut, the clamping of the compressor area can also be carried out partly or completely by means of the third fastening area and the turbine disks which are in turn supported against the first fastening area by the compressor disks, when the turbine rotor with clamped turbine disks is completely clamped by the third fastening area. On the other hand, when a clamping element cooperating with the second fastening area is fastened axially only on one side and the preloading between the first fastening area and second fastening area is greater than the clamping in the turbine area, or if this clamping element can be fastened axially on both sides as is the case, for example, with a rear or rearmost compressor disk which is supported against an axial stop by a threaded nut, the clamping of the compressor area and turbine area can be carried out independently from one another to a great extent in that the compressor disks are clamped between the first fastening area and second fastening area and the turbine disks are clamped between the second fastening area and third fastening area. In this case, for example, a rearmost compressor disk which is fastened axially only on one side by a threaded nut does not lift off from the threaded nut also when the turbine rotor with the clamped turbine disks is fully clamped.

Therefore, the fastening areas can preferably be designed in such a way that a preloading which clamps the compressor disks together also remains in the compressor area itself when the turbine area is clamped. For example, this can be adjusted in a deliberate manner by means of corresponding axial distances between the fastening areas. The preloading between the first fastening area and second fastening area, i.e., in the compressor area, can preferably be at most 10-times, particularly preferably at most 5-times, and more preferably at most 3-times the preloading between the second fastening area and third fastening area, i.e., in the turbine area, and on the other hand can be greater than this preloading in the turbine area.

As was explained above, a turbine rotor according to the invention is particularly suitable for gas turbines with a housing which is not divided continuously, i.e., gas turbines which have a one-piece compressor housing or a compressor housing which is divided in a first, e.g., horizontal plane and a one-piece turbine housing connected to the compressor housing or a turbine housing which is divided in a second plane different from the first plane, e.g., transverse to the longitudinal axis, or which is vertically divided.

BRIEF DESCRIPTION OF THE DRAWINGS

Additional features and advantages are described below in connection with the drawings in which.

DETAILED DESCRIPTION OF THE PRESENTLY PREFERRED EMBODIMENTS

Figure 1:
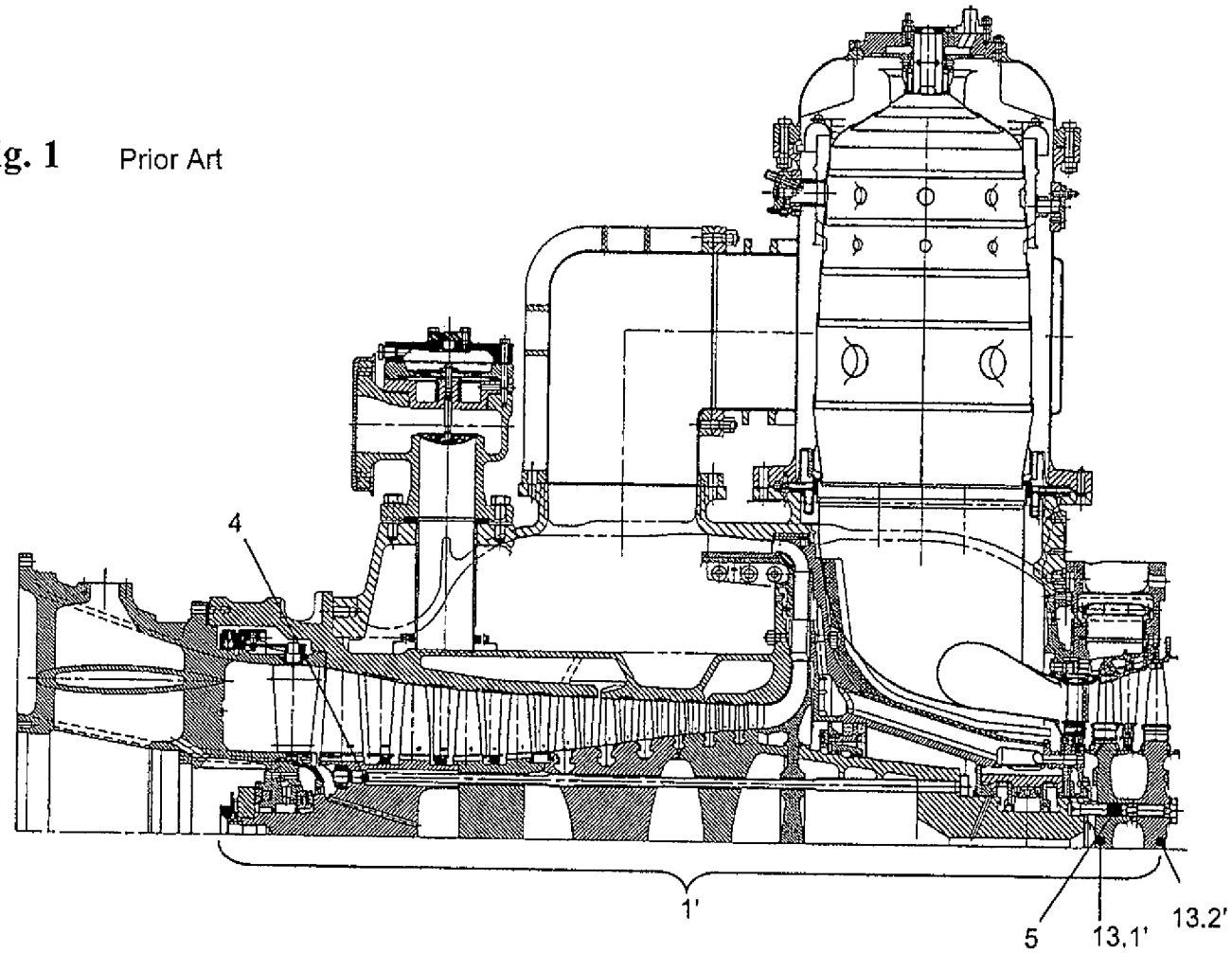
Fig. 1 Prior Art
FIG. 1 is the top longitudinal sectional view through a prior art gas turbine.
Figure 2:
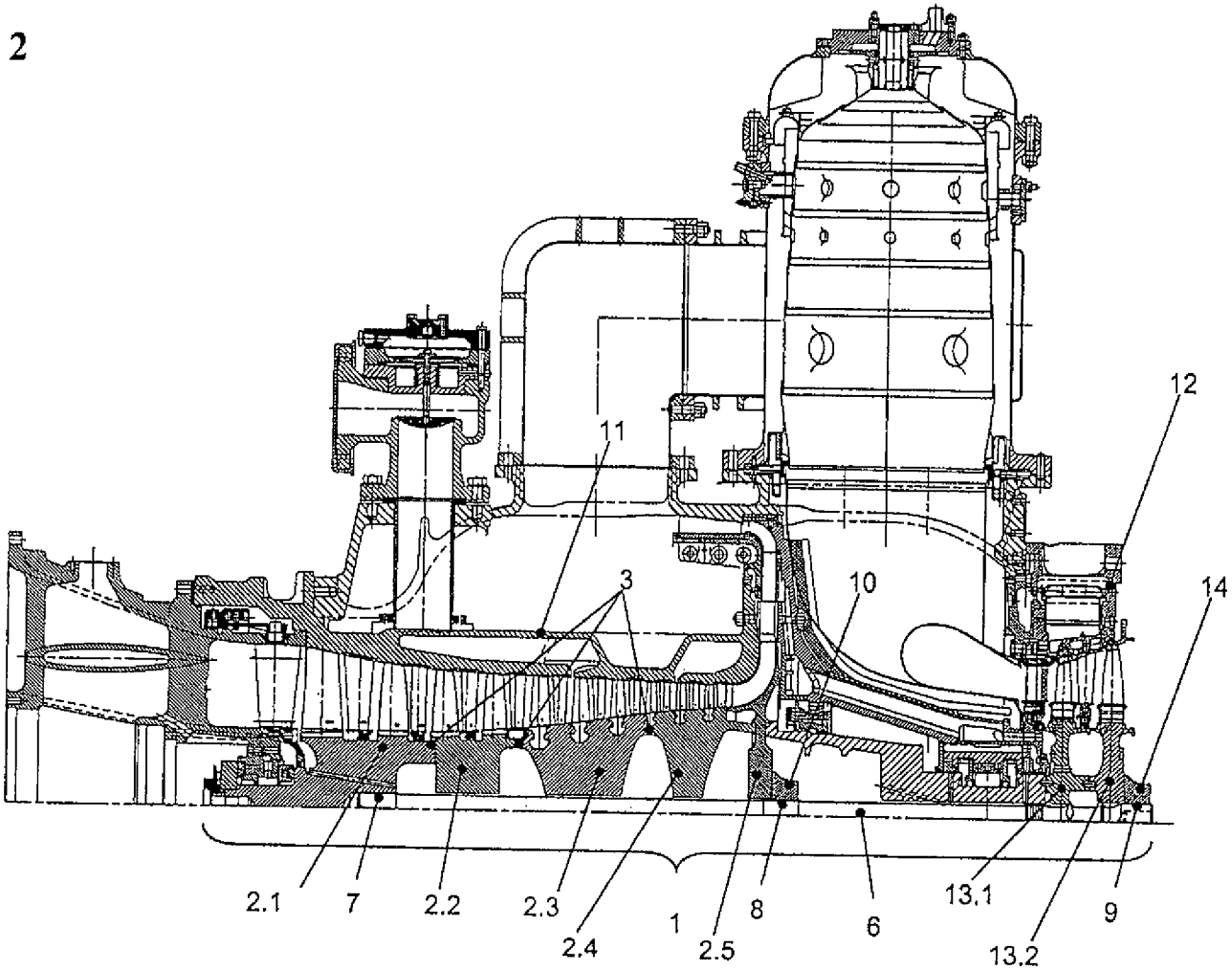
FIG. 2 is a gas turbine according to an embodiment of the present invention in a view corresponding to FIG. 1.

FIG. 2 shows the top longitudinal section through a gas turbine according to an embodiment of the present invention. It comprises a turbine rotor 1 according to an embodiment of the present invention which is formed of a plurality of compressor disks 2.1 to 2.5 and a plurality of turbine disks 13.1, 13.2 in a disk-type construction.

All of the disks 2.1 to 2.5, 13.1 and 13.2 are clamped together by an individual central tie rod 6. For this purpose, the tie rod 6 has a first thread 7 at its front end (at left in FIG. 2), a third thread 9 at its rear end (at right in FIG. 2), and a second thread 8 between the two ends in the area of the rearmost compressor disk 2.5. While the first thread 7 is screwed into the frontmost compressor disk 2.1 considered in the through-flow direction of the gas turbine (from left to right in FIG. 2), a second and third nut 10 and 14, respectively, are screwed onto the second and third threads 8, 9 from the back considered in the through-flow direction by means of a hydraulic clamping device (not shown) so that the compressor area is clamped by the second nut 10 and the turbine area is clamped by the third nut 14.

The preloading is selected in such a way that when the third nut 14 is clamped the second nut 10 is also preloaded and cannot lift off from the rearmost compressor disk 2.5.

The individual compressor disks 2.1 to 2.5 are centered with respect to one another by a Hirth-type spur toothing 3.

For mounting, the compressor disks 2.1 to 2.5 are first joined together and centered relative to one another by means of a Hirth-type spur toothing 3. The tie rod 6 is then screwed into the frontmost compressor disk 2.1 by the first thread 7, the frontmost compressor disk 2.1 having a corresponding centric internal thread for this purpose. The tie rod 6 is preloaded in the area between the first and second threads 7, 8 by means of the second nut 10 which is screwed onto the second thread 8.

The rotor is then balanced. After the balancing of the rotor which only comprises the compressor area up to that time, the turbine disks 13.1, 13.2 are fitted to the tie rod 6 and fixed by means of the third nut 14 which is screwed to the third thread 9. The turbine rotor 1 can now be balanced in its entirety.

The turbine disks 13.1, 13.2 are then removed from the tie rod 6 after loosening the third nut 14, and the rotor which now comprises only the compressor area is inserted from the top into a horizontally divided compressor housing 11 which is then closed.

The turbine disks 13.1, 13.2 are now mounted alternating with a one-piece turbine housing 12 in that they are fitted to the tie rod 6 successively. After the rearmost turbine disk 13.2 is mounted, the tie rod 6 is also clamped in the area between the second thread 8 and the third thread 9 by means of the third nut 14 which is screwed onto the third thread 9.

In so doing, the tightening torque of the third nut 14 is selected in such a way that the second nut 10 also remains preloaded, i.e., exerts a normal force against the rearmost compressor disk 2.5. In so doing, care must be taken that the preloading force of the third nut 14 reduces the preloading force of the second nut 10 in a corresponding manner because it is likewise clamped against the first thread 7, i.e., imparts a tensile force in the entire tie rod 6. However, a greater preloading can be realized in the compressor area than in the turbine area through a corresponding choice of tightening torque of the second nut 10 and third nut 14.

As follows from the preceding description, the entire turbine rotor can be advantageously clamped by means of common tie rods without needing to fix the compressor area by additional tools when the design of the housing does not permit the rotor to be fully assembled outside of the gas turbine.

The balanced state of the separately pre-balanced compressor area is advantageously retained because the compressor disks are constantly preloaded.

The invention is not limited by the embodiments described above which are presented as examples only but can be modified in various ways within the scope of protection defined by the appended patent claims.

The invention claimed is:

1. A method for mounting a turbine rotor for a gas turbine comprising a compressor area and a turbine area, said turbine area comprising at least two compressor disks (2.1-2.5) in the compressor area and at least one turbine disk (13.1, 13.2) in the turbine area, a tie rod arrangement for clamping together said compressor disks and turbine disk, said tie rod arrangement comprising at least one tie rod (6) including a first fastening area (7), a second fastening area (8) for clamping at least two said compressor disks between said first fastening area and said second fastening area, and a third fastening area (9) for clamping said at least one turbine disk, in a gas turbine comprising one of a one-piece compressor housing (11), a compressor housing (11) divided in a first plane; a one-piece turbine housing (12) connected to said compressor housing (11) and a turbine housing (12) divided in a second plane different from the first plane; said method comprising the steps of: a) clamping at least two compressor disks (2.1-2.5) between the first fastening area and the second fastening area by means of the tie rod arrangement to provide a preloading between the first fastening area and the second fastening area; f) arranging the clamped compressor disks in the compressor housing (11), without having released the preloading; and g) clamping at least one turbine disk (13.1, 13.2) while retaining the preloading, wherein the preloading between the first fastening area and second fastening area is greater than the clamping of the at least one turbine disk.

2. The method according to claim 1, additionally comprising the step of: b) balancing the turbine rotor (1) before clamping the turbine disks (13.1, 13.2).

3. The method according to claim 1, additionally comprising the steps of: c) clamping at least one turbine disk (13.1, 13.2); d) balancing the turbine rotor (1); and e) disengaging the turbine disks from the tie rod arrangement before arranging the clamped compressor disk (2.1-2.5) in the compressor housing (11).

4. The method according to claim 1, wherein one of the least two compressor disks (2.1-2.5) and the at least one turbine disk (13.1, 13.2) are clamped by means of one of a hydraulic clamping device and so as to be controlled with respect to torque.

* * * * *